US005810027A

United States Patent [19]

Frantzeskakis

[11] Patent Number: 5,810,027

[45] Date of Patent: Sep. 22, 1998

[54] APPLICATOR WITH TELESCOPIC HANDLE

[76] Inventor: Mike Frantzeskakis, 4124 Pinewood Lake, Bakersfield, Calif. 93309

[21] Appl. No.: 699,841

[22] Filed: Aug. 20, 1996

[51] Int. Cl.[6] ..... A45D 40/26

[52] U.S. Cl. ..... 132/320; 15/144.4; 15/230.11

[58] Field of Search ..... 15/104.93, 144.4, 15/244.1, 244.2, 230.11, 257.01, 257.06, 104.002; 132/317, 318, 320, 308; 604/2; 401/208

[56] References Cited

U.S. PATENT DOCUMENTS

| | | | |
|---|---|---|---|
| D. 300,957 | 5/1989 | Moore . | |
| D. 308,734 | 6/1990 | Markovich et al. . | |
| D. 337,856 | 7/1993 | Butler et al. | 401/208 |
| 3,103,682 | 9/1963 | Markle | 15/244.1 |
| 3,226,754 | 1/1966 | Brittain | 15/230.11 |
| 3,369,269 | 2/1968 | Deck et al. . | |
| 3,751,748 | 8/1973 | Roe et al. . | |
| 3,866,257 | 2/1975 | Cansdale, Sr. . | |
| 4,084,286 | 4/1978 | Post | 15/104.93 |
| 4,135,274 | 1/1979 | Freeman | 15/144.4 |
| 4,396,028 | 8/1983 | Waggoner . | |
| 4,559,157 | 12/1985 | Smith et al. | 15/104.93 |
| 5,167,069 | 12/1992 | Quinn . | |
| 5,176,754 | 1/1993 | Hirzel . | |
| 5,324,127 | 6/1994 | Cortez | 401/208 |
| 5,360,111 | 11/1994 | Arispe . | |
| 5,419,646 | 5/1995 | Taylor . | |
| 5,504,962 | 4/1996 | Byun | 132/317 |

FOREIGN PATENT DOCUMENTS

| | | | |
|---|---|---|---|
| 4236050 | 11/1993 | Germany | 401/208 |
| 2046596 | 11/1980 | United Kingdom | 401/208 |

*Primary Examiner*—Todd E. Manahan
*Assistant Examiner*—Eduardo C. Robert
*Attorney, Agent, or Firm*—Gene Scott-Patent Law & Venture Group

[57] ABSTRACT

An applicator roller element has a cylindrical shape and is mounted on the end of a handle element upon which it may rotate. The roller may be saturated with sun-tan lotion for instance for application to the skin, where the lotion is then transferred to the skin by rolling action of the roller element with respect to the handle element. The handle element is constructed so as to collapse into the roller element axially to make a compact unit for storage in a case. In one embodiment a connection rod element providing attachment of the handle to the roller is able to telescopically collapse into the handle element, while the handle element is able to collapse into the roller element for improved compact storage.

10 Claims, 2 Drawing Sheets

APPLICATOR WITH TELESCOPIC HANDLE

BACKGROUND OF THE INVENTION

1. Field of the Invention

This invention relates generally to applicators, and more particularly to a collapsible lotion applicator for compact storage.

2. Description of Related Art

The following art defines the present state of this field:

Arispe, U.S. Pat. No. 5,360,111 describes a compact applicator for tanning lotions and the like reattachably disassembles. A telescoping handle removably attaches to an applicator base. When disassembled from the applicator base, the telescoping handle collapses and with the applicators base, fits within a closable compact for easy carrying and storage.

Taylor, U.S. Pat. No. 5,419,646 describes a lotion applicator with a hinged extension arm that includes an upper extension arm formed as an elongated cylindrical member with an upper region and a lower region. The lowermost extent of the lower region includes a coupling device for attachment thereto. A lower extension arm is formed as an elongated cylindrical member having an upper region and a lower region. The uppermost extent of the upper region includes a coupling device for attachment thereto. The lowermost extent of the lower region is formed in an L-shaped configuration. A coupling screw is adapted to couple the upper extension arm to the lower extension arm at their respective coupling devices. An open cell foam sponge is shaped in a generally planar, oval configuration with an upper surface and a lower surface. The sponge includes a middle section with a small thickness and rounded ends with a large thickness. A sponge coupling mechanism joins the lowermost extent of the lower extension arm to the upper surface of the sponge. The mechanism includes an aperture for the introduction of liquid into the sponge.

Waggoner, U.S. Pat. No. 4,396,028 describes a suntan lotion applicator device consisting of an extensible handle, an applicator holder adjustably mounted on one end of the handle, and a cover for the applicator. The holder is pivotally mounted between two segments of the holder and is provided with recesses for engagement with a device on the handle to engage one of the recesses to maintain a selected annular position of the applicator holder.

Moore, U.S. Pat. No. D300,957 describes a design for a cylindrical roller applicator for dispensing cream or lotion.

Markovich, U.S. Pat. No. D308,734 describes a design for a lotion roller applicator.

Deck et al, U.S. Pat. No. 3,369,269 describes a paint roller including a cover plate which is selectively positioned over the free end of the roller to act as a paint screen and thus prevent the undesired contact of the paint filled roller with surfaces which are not to be painted.

Cansdale, Sr., U.S. Pat. No. 3,866,257 describes a paint roller intended for use in the painting of walls and ceilings and including an axle adapted to have a paint roller rotatably supported thereon with the ends of the axle secured by brackets to the end of a handle, the point of securement between the handle and the bracket being a swivel joint to permit rocking movement of the roller in opposite directions of the axis and the axle axis, the length of the handle being adjustable to accommodate the painting of ceilings of various heights without the use of a ladder.

Hirzel, U.S. Pat. No. 5,176,754 describes a hand held coating apparatus that is comprised of first and second applicators in one apparatus. The handle is located in between the first and second applicators. The first applicator head, located on one end of the handle, is rotatable and the second applicators head, located on the opposite end of the handle, is non-rotatable, which is stationary head. Rotatable applicator is comprised of a sleeve and a sponge cover, which are secured on a rod end. The rotatable applicator is for rapid and evenly spreading coating material. Non-rotatable applicator is for mixing, dabbing, and applying coating material in hard to reach areas. The apparatus is small enough to be flipped over with a single hand motion, which allows the user to implement each applicator individually. The apparatus can be used for coating, such as paint, art work, make-up applications, body massage or cooking practices Roe et al, U.S. Pat. No. 3,751,748 describes a roller frame that includes an expandable core on the roller frame shaft having plural expandable fingers which are forced radially outwardly into frictional engagement with the inner diameter of a roller cover telescoped over the expandable fingers during axial movements to an axially stationary cam hub on the shaft.

Quinn, U.S. Pat. No. 5,167,069 describes a razor shaving apparatus that is provided having a telescopically extendible and retractable body with a manual handle at one end, and having a soap or lotion applicator detachably secured to the razor shaving assembly.

Lotions, especially for sun tanning, are most usually applied manually. However, manual application is problematic in that it is generally impossible to apply lotion to certain parts of ones own back, and most difficult to apply a uniform coating to many parts of the body, especially by those with restrictions in their body mechanics, such as the ill, handicapped or aged. Mechanical applicators include those, as shown above, with long handles which provide the advantage of reach, but the disadvantage of not being compact for convenient storage. Additionally, many applicators present the problem of not having a convenient way to seal the applicator after its use so as to keep it clean and to prevent lotion from dripping onto other items in ones beach bag or such.

The present invention overcomes these problems and provides further related advantages as described in the following summary.

SUMMARY OF THE INVENTION

The present invention teaches certain benefits in construction and use which give rise to the objectives described below.

The present invention provides an applicator roller element having a cylindrical shape and mounted on the end of a handle element upon which it may rotate. The roller may be saturated with sun-tan lotion for instance for application to the skin, where the lotion is then transferred to the skin by rolling action of the roller element with respect to the handle element. The handle element is constructed so as to collapse into the roller element axially to make a compact unit for storage in a case. In one embodiment a connection rod element providing attachment of the handle to the roller is able to telescopically collapse into the handle element, while the handle element is able to collapse into the roller element for improved compact storage.

Therefore, a primary objective of the present invention is to provide a lotion applicator capable of rolling on the skin while being held by a handle of such length as to allow an individual to reach all parts of his/her body including the middle back. Another objective is to provide such an applicator that is capable of collapsing into a small unit for storage. A further objective is to provide a carrying case capable of storing the applicator when not in use and in its collapsed state so that lotion remaining in the applicator is restricted and so that the applicator may be easily transported and carried adjacent to other items.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

Figure 1:
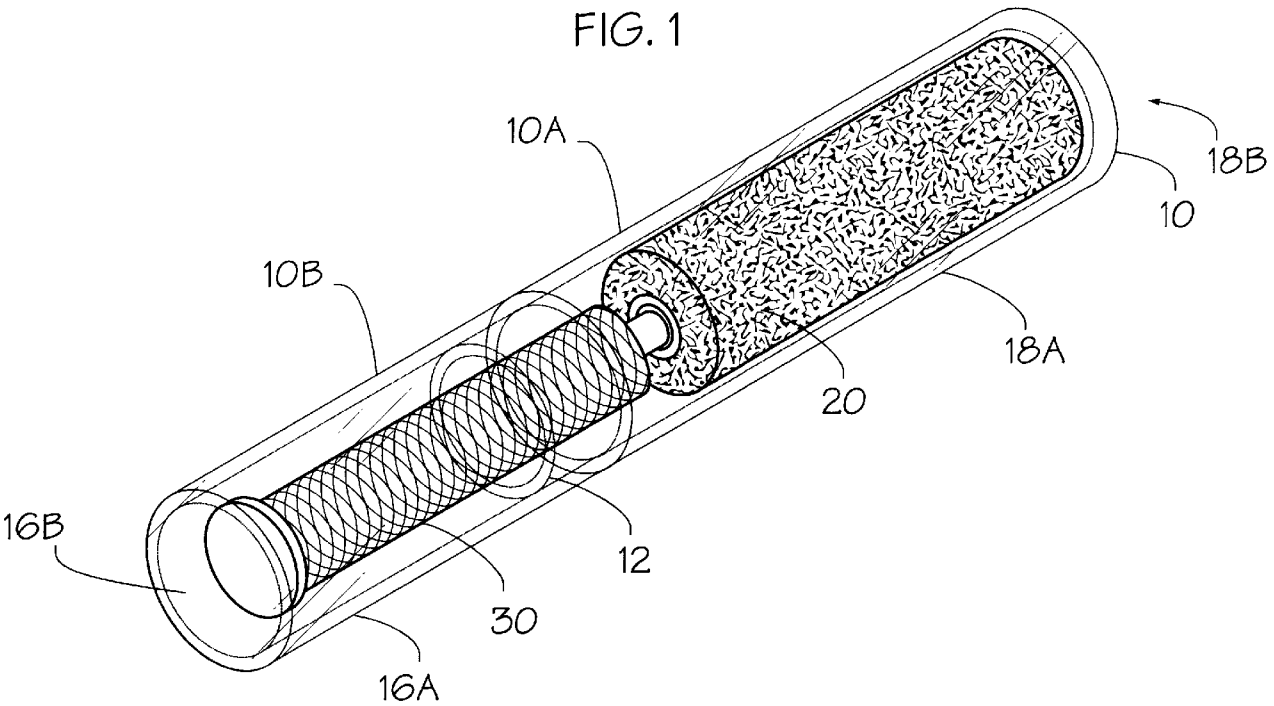
FIG. 1 is a perspective view of a first embodiment of the applicator and storage case of the present invention.
Figure 3:
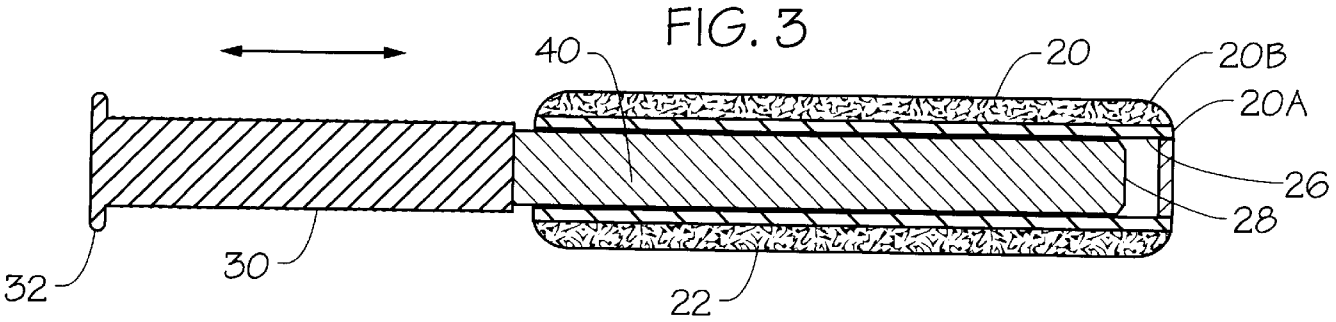
FIG. 3 is a side view of the applicator thereof shown in cross-section in an engaged position.
Figure 4:
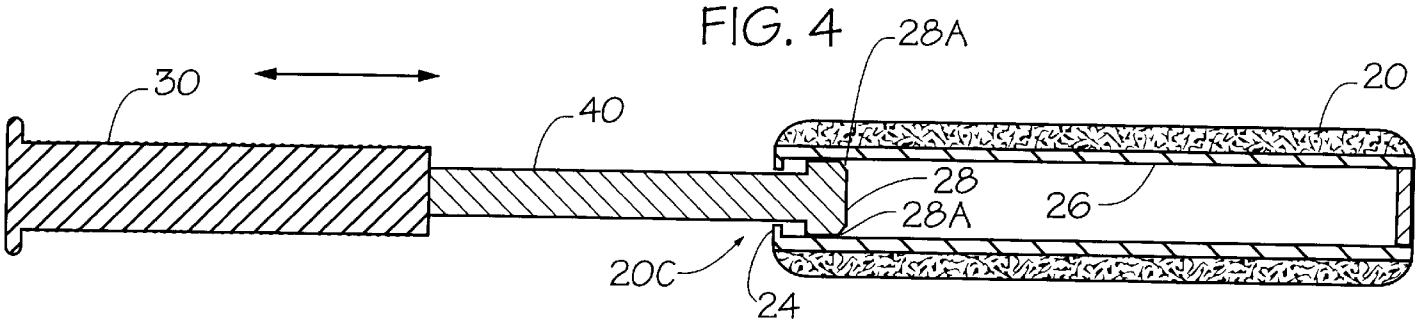
FIG. 4 is a side view of a second embodiment of the applicator of the present invention shown in cross-section in a withdrawn position.
Figure 5:
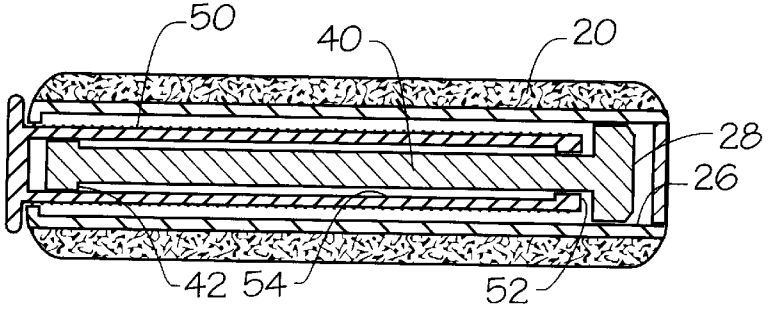
FIG. 5 is a side view of a third embodiment of the applicator of the present invention shown in cross-section with the handle engaged within the roller and with an interconnection rod engaged within the handle.

The above described drawing figures illustrate the invention, an application device for lotions and the like. The device preferably includes a cylindrical roller 20 providing an inner rigid structural layer 20A supporting an outer absorbent layer 20B. The absorbent layer 20B is preferably a sponge or other fabric capable of absorbing a lotion or other liquid (not shown), and for dispensing the liquid upon pressing the surface 22 of the absorbent layer 20B against the skin or other surface (not shown). The structural layer 20A is preferably a plastic molded part having a smooth, constant diameter, inner annular surface 26. The roller 20 provides an aperture 20C at one end. The other end is preferably at least partially capped as shown in FIGS. 3, 4, and 5. A handle 30 is positioned laterally on the longitudinal axis of the roller 20. Colinearly extending from one end of the handle 30, an interconnect rod 40 is slidably engaged within the roller 20, gaining access thereto through the aperture 20C. In a first embodiment, shown in FIG. 3, the interconnect rod 40 moves in sliding contact with the inner annular surface 26 of the rigid structural layer 20A. In a second embodiment, shown in FIG. 4, the interconnect rod 40 provides a free end 28 with an end annular surface 28A, this surface being in contact with the inner annular surface 26, but not the bulk of the rod 40. As best shown in FIGS. 1 and 3, the interconnect rod 40 is positionable within the roller 20 at a first inserted position, the interconnect rod 40 being fully enclosed within the roller 20. In this case the handle 30 extends from the aperture 20C of roller 20. Alternately, as shown in FIG. 4, the interconnect rod 40 may be extended to a position where the interconnect rod 40 is withdrawn from the roller 20 except for the end annular surface 28A. A means for preventing withdrawal of the end annular surface 28A from the roller 20 is preferably an annular lip 24 defining the aperture 20C. The interconnect rod 40 of FIG. 3 is able, also, to be withdrawn to any selected extent, thereby providing an enhanced reach, yet still supporting the roller 20 thereon.

Figure 2:
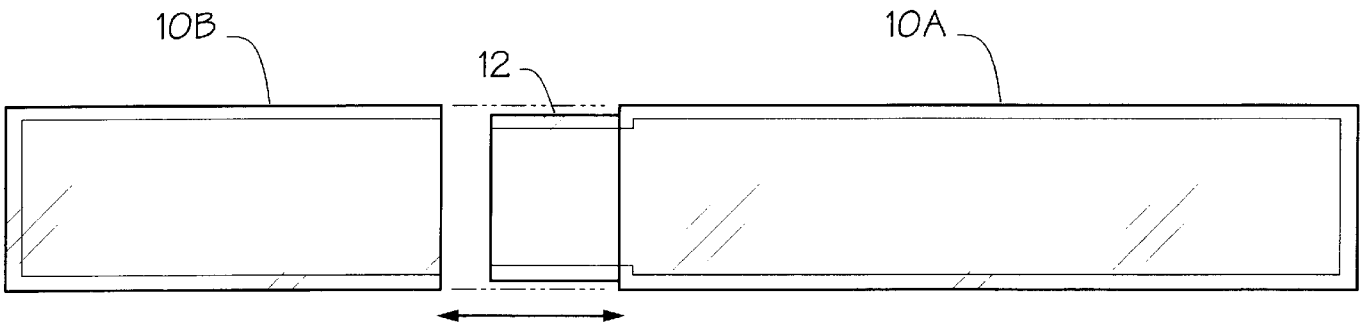
FIG. 2 is a side view of the storage case thereof shown in an open orientation.

As shown in FIG. 2, a cylindrical carrying case 10 is preferably provided. It includes an inner storage space of such size for tightly fitting the roller 20 and handle 30 when the interconnect rod 40 is placed into the inserted position within roller 20. The case 10 preferably includes a first case portion 10A separable from a second case portion 10B along a circumferential parting line so that with the second case portion 10B removed from the first case portion 10A, the handle 30 is exposed for withdrawal of the applicator from the case 10. Preferably, case portion 10A includes an insert portion 12 adapted for insertion into case portion 10B for interconnecting the portions 10A and 10B. Preferably, the case 10 includes side walls 16A and 18A of circular form and common outside diameter, and a pair of end walls 16B and 18B so that the case 10 fully encloses the applicator 20. This assures that lotion will not escape the confines of the case 10.

In an alternate preferred third embodiment as shown in FIG. 5, the handle 30 is cylindrical in construction providing an annular interior surface 54. The interconnect rod 40 is free to slide within the interior surface 54 so as to telescopically collapse into the handle 30 as desired for storage. The handle 30 provides an exterior surface 50 of lesser diameter than the aperture 20C such that the handle 30 is positionable within the roller 20 for storage. In this instance the cylindrical carrying case 10 provides an inner storage space of such size for tightly fitting the roller 20 when the handle 30 has been fully collapsed into it as shown in FIG. 5. A handle end lip 52 is provided to capture the interconnect rod 40 so that these two parts are not separated when the device is extended to its full length. A handle flange 32 protrudes annularly at the free end of handle 30 providing a gripping ridge to help extract handle 30 from its collapsed position as shown in FIG. 5. An annular rim edge 42 on interconnecting rod 40 helps to prevent handle 30 from parting from interconnecting rod 40 when handle 30 is pulled out to its fully withdrawn position as shown in FIG. 4.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An application device comprising:

a cylindrical roller providing an inner rigid structural layer supporting an outer absorbent layer, the roller providing an aperture at one end thereof;

a handle colinearly and laterally oriented with respect to the roller;

an interconnect rod joining the handle to the roller, the rod being slidably engaged within the roller for translating the roller axially thereon, and rotating the roller thereon;

the interconnect rod positionable within the roller at a first inserted position with the interconnect rod fully enclosed within the roller, the handle extending from the one end of the roller, and at a second extended position with a portion of the interconnect rod withdrawn from the roller such that the roller is extended from the handle for improving the reach of the device;

the interconnect rod providing an end annular surface at a distal end thereof, the surface providing a diameter greater than the diameter of the interconnecting rod, the surface being in sliding contact with an inner annular surface of the rigid structural layer, the roller functionally revolving on the end annular surface of the rod;

wherein the handle is cylindrical in construction providing an annular interior handle surface the interconnect rod being free to slide therein so as to telescopically collapse into the handle, the handle being of such diameter as to be positionable within the roller for storage.

2. The device of claim 1 further including a means for preventing withdrawal of the end annular surface from the roller.

3. The device of claim 2 wherein the withdrawal preventing means is an annular lip positioned at the one end of the roller.

4. The device of claim 1 further including a cylindrical carrying case providing an inner storage space for tightly fitting the roller and handle when the handle is placed into the first inserted position.

5. The device of claim 4 wherein a first case portion is separable from a second case portion.

6. The device of claim 4 further including a liquid product impregnated within the outer absorbent layer, the liquid product being dispensable from the roller upon contact with a surface for accepting the liquid product.

7. The device of claim 6 wherein the case is impermeable and air tight when closed so as to prevent loss of the liquid product in storage.

8. The device of claim 1 further including a cylindrical carrying case providing an inner storage space for tightly fitting the roller when the handle is collapsed therein.

9. The device of claim 8 further including a liquid product impregnated within the outer absorbent layer, the liquid product being dispensable from the roller upon contact with a surface for accepting the liquid product.

10. The device of claim 9 wherein the case is impermeable and air tight when closed so as to prevent loss of the liquid product in storage.

* * * * *